US009144828B2

(12) United States Patent
Shuttleworth et al.

(10) Patent No.: US 9,144,828 B2
(45) Date of Patent: Sep. 29, 2015

(54) OVERSIZED MATERIAL REMOVAL SYSTEM AND METHOD

(71) Applicants: Timothy G. Shuttleworth, Girard, PA (US); Michael L. Shattuck, Erie, PA (US); John Moore, Girard, PA (US)

(72) Inventors: Timothy G. Shuttleworth, Girard, PA (US); Michael L. Shattuck, Erie, PA (US); John Moore, Girard, PA (US)

(73) Assignee: Eriez Manufacturing Co., Erie, PA (US)

( * ) Notice: Subject to any disclaimer, the term of this patent is extended or adjusted under 35 U.S.C. 154(b) by 0 days.

(21) Appl. No.: 13/737,220

(22) Filed: Jan. 9, 2013

(65) Prior Publication Data

US 2013/0175207 A1 Jul. 11, 2013

Related U.S. Application Data

(60) Provisional application No. 61/584,484, filed on Jan. 9, 2012.

(51) Int. Cl.

| | |
|---|---|
| ***B07C 5/04*** | (2006.01) |
| ***B07B 13/04*** | (2006.01) |
| ***B07B 13/05*** | (2006.01) |
| ***B07B 13/00*** | (2006.01) |
| ***B03C 1/14*** | (2006.01) |
| ***B03C 1/30*** | (2006.01) |

(52) U.S. Cl.

CPC . *B07C 5/04* (2013.01); *B03C 1/145* (2013.01); *B03C 1/30* (2013.01); *B07B 13/003* (2013.01); *B07B 13/04* (2013.01); *B07B 13/05* (2013.01); *B03C 2201/20* (2013.01)

(58) Field of Classification Search

CPC ..... B03C 1/247; B03C 1/14; B03C 1/16; B07B 1/04

USPC ..... 209/38, 219, 223.2, 923, 262, 359, 904, 209/907, 908, 241

See application file for complete search history.

(56) References Cited

U.S. PATENT DOCUMENTS

| | | | | | |
|---|---|---|---|---|---|
| 3,042,205 | A | | 7/1962 | Merwin | |
| 3,335,968 | A | | 8/1967 | Young | |
| 4,143,665 | A | * | 3/1979 | Griffin | 460/104 |
| 4,370,225 | A | | 1/1983 | Bingel et al. | |
| 4,883,584 | A | | 11/1989 | Sattler et al. | |
| 5,271,506 | A | * | 12/1993 | Haines | 209/640 |
| 5,394,991 | A | * | 3/1995 | Kumagai et al. | 209/212 |
| 6,149,014 | A | * | 11/2000 | Mankosa et al. | 209/223.2 |

(Continued)

FOREIGN PATENT DOCUMENTS

| | | | | | |
|---|---|---|---|---|---|
| GB | 702729 | | | 1/1954 | |
| GB | 870342 | | | 6/1961 | |
| GB | 2007538 | A | | 5/1979 | |
| JP | 5146708 | A | | 6/1993 | |
| WO | WO 9744137 | A1 | * | 11/1997 | B03C 1/247 |
| WO | 03068406 | A1 | | 8/2003 | |
| WO | WO 2009124015 | A3 | * | 1/2010 | |

*Primary Examiner* — Jeremy R Severson

(74) *Attorney, Agent, or Firm* — Jonathan M. D'Silva; MacDonald, Illig, Jones & Britton LLP

(57) ABSTRACT

A material removal system for removing oversized materials from a material stream. This material removal system comprises a first transfer system that is used to transport a material stream, a pulley separator, and a gap that is at least as small as the length of the oversized materials that are to be removed from the material stream. Moreover, the pulley separator comprises a rotatable outer shell that has a tubular width and circular cross-section. The pulley separator is located at a discharge end of the first transfer system to create a gap that is at least as small as the length of the oversized materials to be removed.

10 Claims, 6 Drawing Sheets

(56) References Cited

U.S. PATENT DOCUMENTS

| | | | | |
|---|---|---|---|---|
| 6,349,833 | B1 | 2/2002 | Oyama et al. | |
| 6,382,427 | B1 * | 5/2002 | Nakhei-Nejad | 209/700 |
| 6,467,629 | B1 | 10/2002 | Exner | |
| 8,056,728 | B2 | 11/2011 | Riise et al. | |
| 8,196,751 | B2 * | 6/2012 | Shuttleworth et al. | 209/215 |
| 8,398,006 | B2 * | 3/2013 | Gitschel | 241/19 |
| 2012/0111977 | A1 * | 5/2012 | Shuttleworth et al. | 241/24.25 |
| 2013/0014623 | A1 * | 1/2013 | Hiranaka et al. | 83/23 |
| 2013/0240413 | A1 * | 9/2013 | Keaton et al. | 209/3.1 |

* cited by examiner

OVERSIZED MATERIAL REMOVAL SYSTEM AND METHOD

This application takes priority from U.S. Provisional Patent Application 61/584,484 filed on Jan. 9, 2012, which is incorporated herein by reference.

BACKGROUND

What is presented is a system and method for the removal of oversized material from a material stream. Material sorting systems are found in shredding mills, scrap metal plants, and the like, and they typically have sizing grates intended to limit the size of material passing through to the end of the system, ensuring a relatively uniform material size exiting the sorting system. However, these grates will only screen materials in two dimensions and elongated pieces of oversized material, often called "pokers," sometimes pass through. While these pokers represent a tiny percent of the weight passing through these systems, they cause a majority of the material handing problems because these pokers easily jam in transfer chutes, poke holes in belts of conveyors (if any exist), and are hazardous to the operating and handpicking personnel. Thus, it would be desirable to have a system and method that removes oversized material within a material stream.

SUMMARY

What is a presented is an oversized material removal system for the removal of oversized materials from a material stream. The oversized material removal system comprises a first transfer system, for the transportation of a material stream, and a pulley separator, comprising a rotatable outer shell. Furthermore, the outer shell has a tubular width and a circular cross-section. The pulley separator is also located at a discharge end of the first transfer system and creates a gap that is at least the length of the oversized materials.

The oversized material removal system could also comprise a storage device or a second transfer system that is further downstream from the pulley separator. The outer shell of the pulley separator could be rubber coated or have a magnet located within it. Moreover, if there is one, the magnet located within the outer shell could be upwardly oriented. The outer shell of the pulley separator could also have a width that is at least the same as the width of the first transfer system.

The first transfer system of the oversized material removal system could be a conveyor that comprises a drum, which rotates around a central axis, and a belt, which covers the drum. Furthermore, the drum and outer shell both rotate in the same general direction. The outer shell could also generally rotate at a faster rate of speed than the drum. The gap of the oversized material removal system could also be between 12 inches to 24 inches.

Another embodiment of the oversized material removal system for the removal of oversized materials from a material stream comprises a grate used for pre-sorting the material stream, an aligning device used for pre-positioning the oversized materials within the material stream, a conveyor used for the transportation of the material stream, a pulley separator, and a storage device located downstream of the pulley separator. The aforementioned conveyor comprises a drum, that is rotatable around a central axis, and a belt, which covers the drum.

The aforementioned pulley separator of this embodiment comprises a rotatable outer shell and an upwardly oriented permanent magnet, which is located within the outer shell.

Furthermore, the outer shell is rubber coated and has a tubular width and a circular cross-section. The pulley separator is located at a discharge end of the conveyor in such a way that this location creates a gap, which is at least the length of the oversized materials. The drum and outer shell both rotate in the same general direction and the outer shell generally rotates at a faster rate than the drum.

A method of removal of oversized materials from a material stream comprises the first step of conveying a material stream, that includes oversized materials, along a first transfer system to a discharge end of the first transfer system and the second step of conveying the oversized material, from the discharge end of the first transfer system, over a pulley separator, which is located downstream from the first transfer system across a gap between the first transfer system and the pulley separator that is at least the length of the oversized materials.

The method of removal of oversized materials could also comprise and additional step of conveying the oversized material, from over the pulley separator, to a second transfer system or a storage device that is located downstream from the pulley separator.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
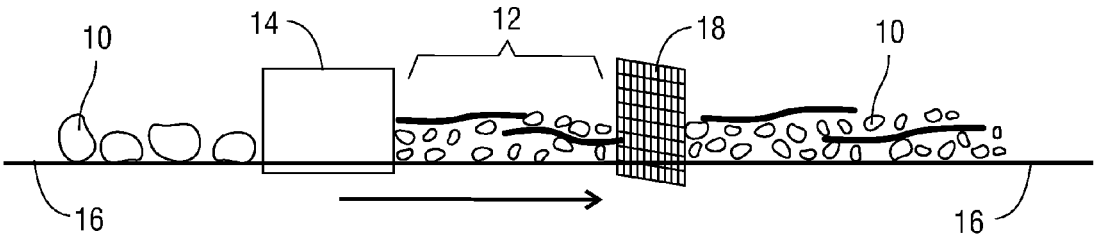
Prior Art Fig.1
FIG. 1 shows a side view of the prior art components of a material transfer and sorting system.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

As shown in FIG. 1, material transfer and sorting systems found in shredding mills, scrap metal plants, and the like, process material 10 in a material stream 12 by first breaking up the material 10 into manageable chunks to free up different material types, so that the material 10 can be sorted and graded by the downstream processes. This incoming material 10 is typically shredded, ground up, crushed, and/or torn at a breaking site 14 before the material 10 is ejected onto a first transfer system 16, and then carried downstream for processing. The breaking site 14 may be a crusher, a shredder, or other device or combination of devices. The first transfer system 16 may be a conveyor, an angled chute, or any other appropriate system or combination of systems.

Figure 2:
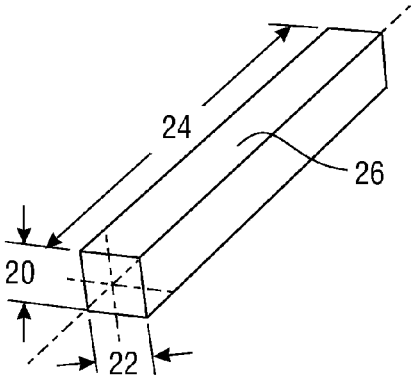
FIG. 2 shows a perspective view of a single elongated piece of oversized material.
Figure 3:
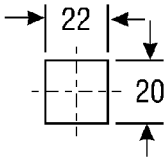
FIG. 3 shows a front view of a single elongated piece of oversized material.
Figure 4:
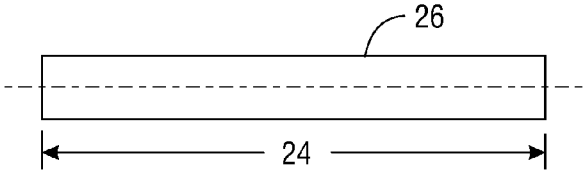
FIG. 4 shows a side view of a single elongated piece of oversized material.

At least one sizing grate 18 is installed downstream of the breaking site 14 to presort the material stream 12 and further limit the size of the material 10 within the material stream 12 that is moving along the first transfer system 16. The grate 18 helps to ensure that there is a relatively uniform material stream 12 transporting along the first transfer system 16. The grate 18 typically has, but is no way limited to, a plurality of openings that are 5 inches by 8 inches in the height and width dimensions, respectively. However, as can be seen in the prior art shown in FIGS. 2 through 4, a major limitation of these grates is that they will only screen materials in the two dimensions of height 20 and width 22, but not length 24. It is commonplace for elongated pieces of oversized material 26 to pass through the grate 18 and continue transporting downstream on the first transfer system 16. These elongated pieces of oversized material 26, sometimes called "pokers," are long axis bars, short in height 20 and width 22, having lengths 24 beginning from around two feet to much longer. While oversized material 26 represents a tiny percent of the weight passing along the first transfer system 16, oversized material 26 is a major cause of downstream disruptions.

Oversized material 26 removal is even more necessary when the material stream 12 of the material sorting systems takes at least one sharp turn during transfer, potentially causing pieces of oversized material 26 to get jammed and obstruct the flow of the material stream 12 behind the oversized material 26. This obstruction can severely damage parts of the material sorting system's first transfer system 16 or other components. This obstruction can also cause lost production time and waste workforce effort to clear the oversized material 26 from the obstructed material stream 12.

Figure 5:
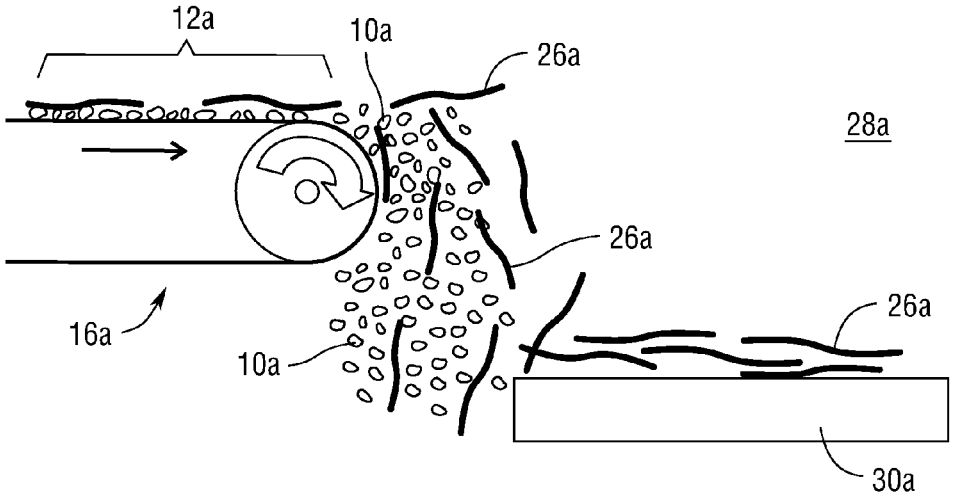
Prior Art Fig.5
FIG. 5 shows a side view of a prior art static oversized material removal system.

Solutions to the problems caused by these escaping oversized material 26 pieces have been attempted in the past. As shown in FIG. 5, prior art static oversized material removal systems 28*a* are non-driven, not active, and leave much to be desired. These static oversized material removal systems 28*a* essentially rely upon the oversized material 26*a*, traveling in the material stream 12*a* and along a first transfer system 16*a*, to simply lodge themselves on a capturing platform 30*a*, typically a sheet or shelf, that is situated a short distance beyond the natural trajectory of the material stream 12*a* while falling off the discharge end of the first transfer system 16*a*. Using this system, very few pieces of oversized material 26*a*, except the exceptionally elongated ones, actually get removed from the material stream 12*a* because most pieces of oversized material 26*a* end up falling back in with the rest of the material stream 12*a* when they miss the capturing platform 30*a*.

Figure 6:
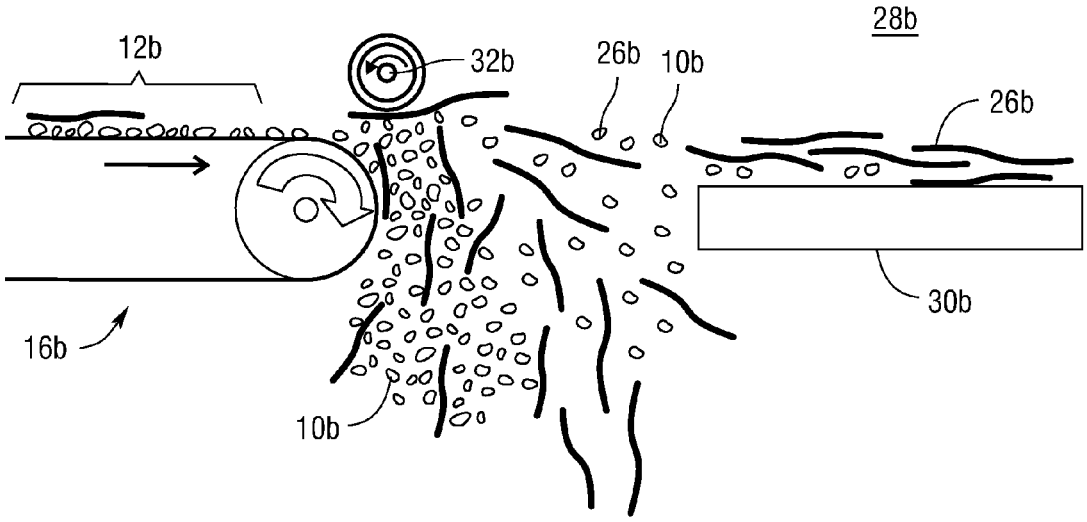
Prior Art Fig.6
FIG. 6 shows a side view of a prior art driven oversized material removal system.

As shown in FIG. 6, another prior art solution that has been created is the driven oversized material removal system 28*b*. This oversized material removal system 28*b* relies upon friction and/or the oversized material's 26*b* own weight to allow capture, making the entire design of the oversized material removal system 28*b* unreliable. These driven oversized material removal systems 28*b* are simply a small diameter rubber coated roller 32*b* located above the discharge end of the first transfer system 16*b*. The roller 32*b* functions by imparting additional momentum to the material 10*b* in the material stream 12*b* with the intention of providing more momentum to the oversized materials 26*b*. However, this system is unreliable as it is possible that some oversized material 26*b* may miss the roller 32*b* entirely or some smaller material 10*b* may be unduly affected by the roller 32*b* and ejected to the capturing platform 30*b*. This type of oversized material removal system 28*b* is particularly ineffective on pieces of oversized material 26*b* that are shorter in size or have abnormal weight distributions, causing this system to be even less reliable in general.

Figure 7:
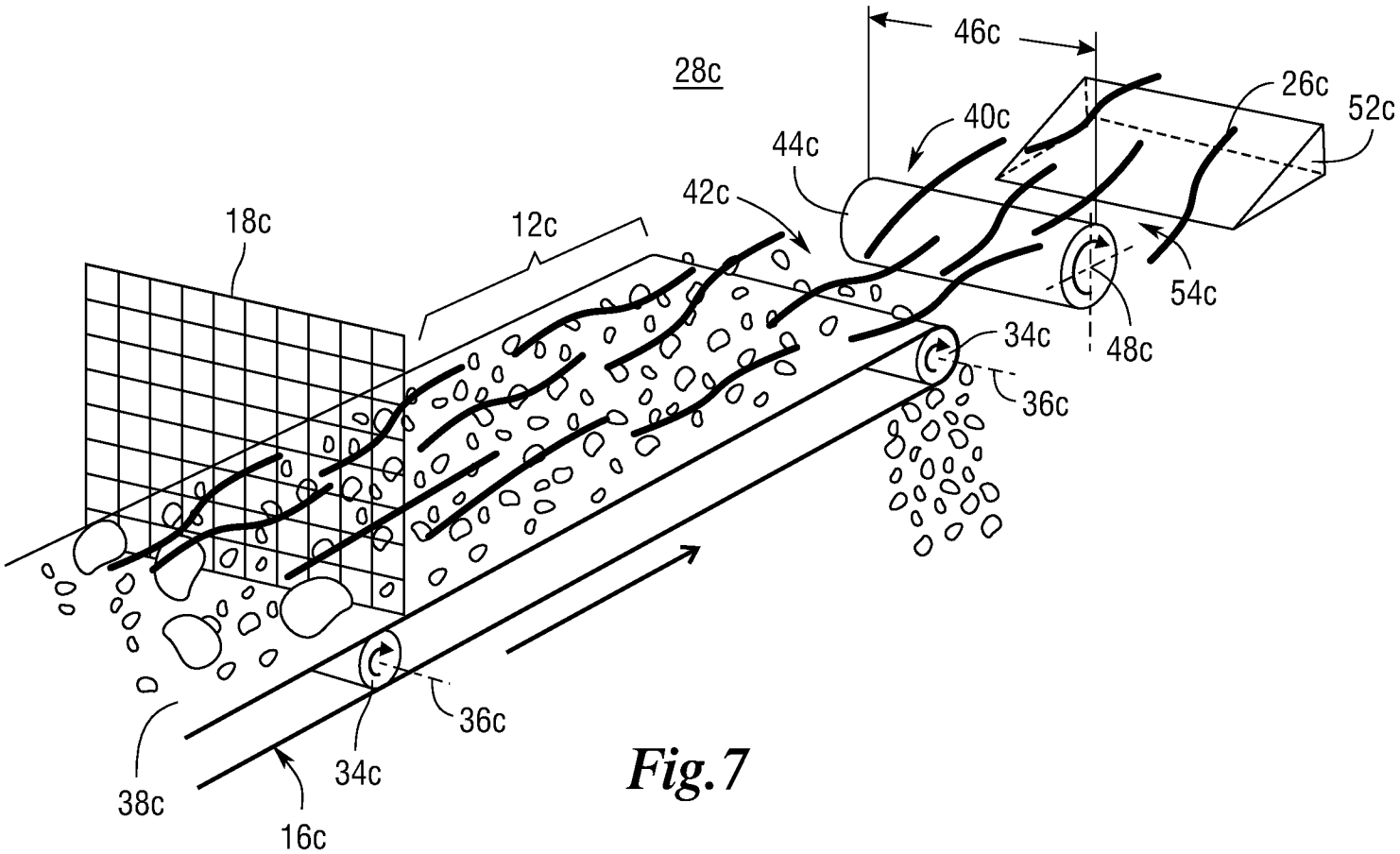
FIG. 7 shows a perspective view of a material stream comprising the first embodiment of the oversized material removal system.
Figure 8:
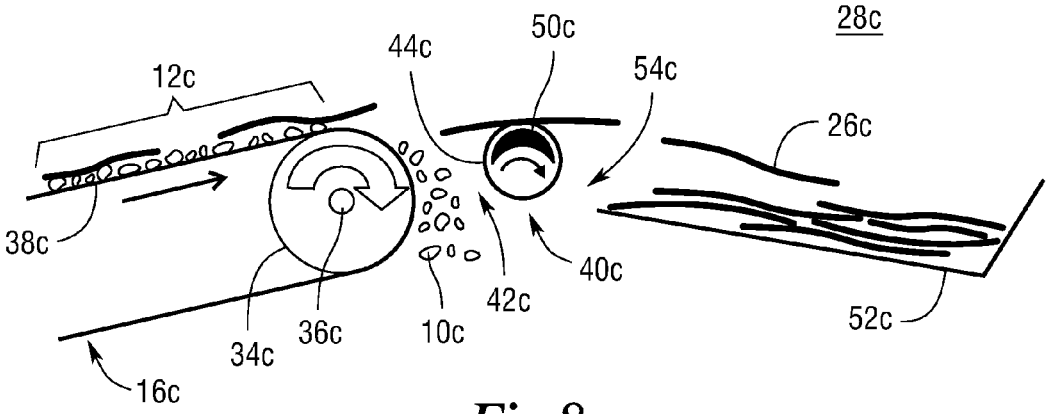
FIG. 8 shows a side view of the first embodiment of the oversized material removal system.

To get around the substantial inefficiencies found in the prior art solutions above, a oversized material removal system 28*c*, that will be discussed in greater detail below, has been created. As shown in FIGS. 7 and 8, a first embodiment of this oversized material removal system 28*c*, comprises a first transfer system 16*c* used for the transportation of the material stream 12*c* to the discharge end of the first transfer system 16*c*. The first transfer system 16*c* in this embodiment is a shown as a conveyor that comprises at least one rotatable drum 34*c*, which rotates around a central axis 36*c*, and a belt 38*c* that covers the rotatable drum 34*c*. It is also possible for the first transfer system 16*c* to comprise an aligning device (not shown) that helps position the material stream 12*c* so oversized material 26*c* within the material stream 12*c* becomes aligned lengthwise while being transported on the first transfer system 16*c*.

A pulley separator 40*c* is located downstream and in line with the discharge end of the first transfer system 16*c*, just beyond a gap 42*c* that is approximately the length of oversized material 26*c* to be removed from the material stream 12*c*. The length of this gap 42*c* typically ranges from around 12 inches to 24 inches, which should be a length that is at least as small as the shortest pieces of the oversized material 26*c*. It will be understood that the length of this gap 42*c* could be selected for the particular application as long as it is long enough to only allow oversized materials 26*c* from the material stream 12*c* to pass over the gap 42*c*.

The pulley separator 40*c* comprises a rotatable outer shell 44*c* that is rotated by a drive mechanism (not shown) and has a tubular width 46*c* and circular cross-section 48*c*. The tubular width 46*c* of the outer shell 44*c* is typically at least the same width of the first transfer system 16*c*. The tubular width 46*c* of the outer shell 44*c* is in line with the width of the first transfer system 16*c* to facilitate removal of oversized material 26*c* at any point along the width of the first transfer system 16*c*. It will be understood that while a tubular width 46*c* of the outer shell 44*c* that is shorter than the width of the first transfer system 16*c* can work, such an arrangement will be unable to service the removal of oversized materials 26*c* from the entire width of the first transfer system 16*c*. The cross-section 48*c* of the pulley separator 40*c* could have a non-circular shape, such as, but not limited to, an octagon, square, oval, etc. shape. Implementing various non-circular shaped cross-sections 48*c* of the outer shell 44*c* may be effective in facilitating the gripping of certain oversized material 26*c* expected to have diversely shaped lengths 46*c* created by kinks, bends, and knots.

A magnet 50*c* is located within the outer shell 44*c*. The magnetic field of the magnet 50*c* attracts oversized materials

26*c* that have ferrous or otherwise magnetic properties against the rotating outer shell 26*c* of the pulley separator 40*c* and be pulled forward by the rotation of the outer shell 44*c*. The magnetic field of the magnet 50*c* helps to prevent oversized material 26*c* from falling backward into the gap 42*c*. Thus, when the material stream 12*c* reaches the gap 42*c*, oversized material 26*c* will pass over the gap 42*c* due to its length as well as be affected by the magnetic field generated by the magnet 50*c* located within the outer shell 44*c*, all other material 10*c* will likely fall into the gap 42*c*.

The magnet 50*c* is typically upwardly oriented because oversized material 26*c* passes over the top of the pulley separator 40*c*. It will be understood that any orientation of the magnet 50*c* may work, so long as oversized material 26*c* can pass over the pulley separator 40*c*. The magnet 50*c* is typically a permanent magnet. However, it will also be understood that other varieties of magnets may work, such as electro-magnets, so long as the magnetic field of the magnet 50*c* is strong enough to help prevent oversized material 26*c* from falling back into the gap 42*c* after the oversized material 26*c* comes into contact with the pulley separator 40*c*.

The outer shell 44*c* of the pulley separator 40*c* rotates in the same direction as the movement of the material stream 12*c* on the first transfer system 16*c*. Typically, the outer shell 44*c* rotates at a faster rate of speed than the material stream 12*c* is moved across the first transfer system 16*c*, so as to facilitate the quick removal of the oversized material 26*c*. Generally the outer shell 44*c* rotates 25% to 50% faster than the material stream 12*c* moves along the first transfer system 16*c*. It will be understood that rotating the outer shell 44*c* at any speed to facilitate the removal of the oversized material 26*c* will work. It is also possible to incorporate a timing device (not shown) with the outer shell 44*c* so as to vary the rotational speed of the outer shell 44*c* at different set time increments, further helping to facilitate removal of the oversized material 26*c*.

Further downstream, beyond the pulley separator 40*c*, lies a storage device 52*c* that is typically a shelf, sheet, or collection bin, for collecting each piece of oversized material 26*c* that has passed over the pulley separator 40*c*. It will be understood that any type of storage device able to collect each piece of oversized material 26*c* passed over the pulley separator 40*c* will work. Moreover, there is a short distance between the downstream side of the pulley separator 40*c* and the storage device 52*c*, creating a much smaller second gap 54*c* that only oversized material 26*c* can easily slide over. Any material 10*c* from the material stream 12*c* that mistakenly goes over the pulley separator 40*c* will drop off on the downstream side of the pulley separator 40*c* into the second gap 54*c*, sending this material 10*c* back with the rest of the material stream 12*c*.

Figure 9:
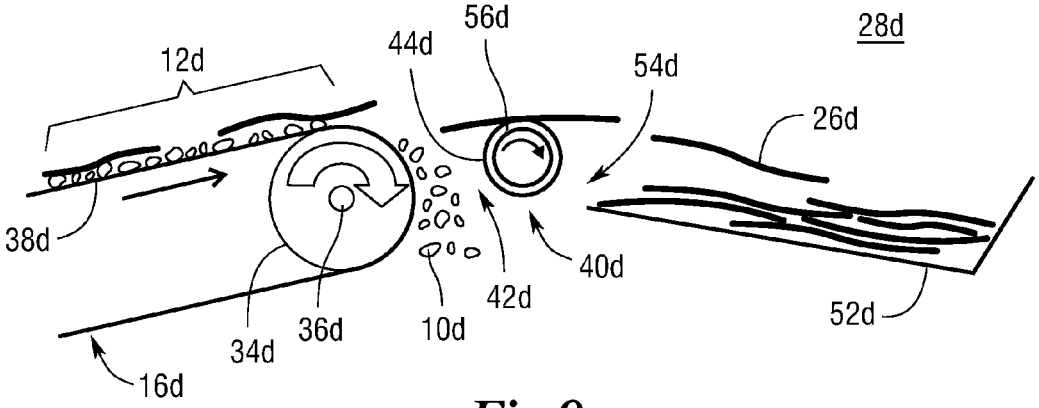
FIG. 9 shows a side view of a second embodiment of the oversized material removal system where the pulley separator has a rubber coat around the drum.

In a second embodiment of oversized material removal system 28*d* shown in FIG. 9, the pulley separator 40*d* comprises a rotatable outer shell 44*d* that is rotated by a drive mechanism (not shown) and has a tubular width 46*d* and circular cross-section 48*d*. The outer shell 44*d* has a rubber coat 56*d* covering the outer shell 44*d*. The rubber coat 56*d* uses the friction of the rubber coat 56*d* against the oversized material 26*d* to pull the oversized material 26*d* forward and across the top of the pulley separator 40*d* with the rotation of the outer shell 44*d*. The rubber coat 56*d* can be particularly effective in situations where the material stream 12*d* comprises oversized material 26*d* having no ferrous properties. Thus, when the material stream 10*d* reaches the gap 42*d*, oversized material 26*d* will pass over the gap 42*d* due to its length and be affected by the frictional grip of the rubber coat 56*d* covering the outer shell 44*d*, all other material 10*d* should fall into the gap 42*d*. Typically the rubber coat 56*d* covers the entire outer shell 44*d*. It will be understood that the rubber coat 56*d* could cover any portion of the outer shell 44*d* so long as oversized material 26*d* can be effectively gripped and pulled across the top of the pulley separator 40*d* by the rotation of the outer shell 44*d*.

Figure 10:
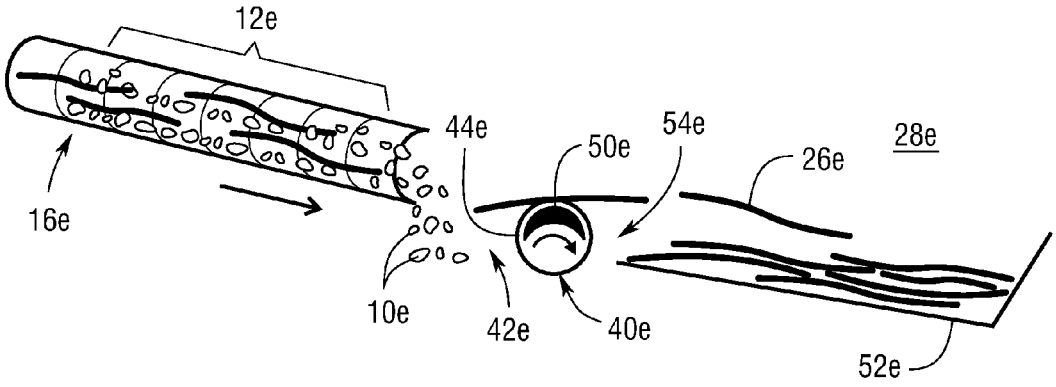
FIG. 10 shows a side view of a third embodiment of the oversized removal system.

As shown in FIG. 10, the third embodiment of the oversize material removal system includes a first transfer system 16*e* that is a chute used for the transportation of the material stream 12*e*. The first transfer system 16*e* relies on gravity to move the material stream 12*e* forward, until the material stream 12*e* reaches the discharge end of the first transfer system 16*e*. Typically the chute 12*e* is designed to have a channel shape or side walls so that a majority of the material stream 12*e* remains on the first transfer system 16*e* and does not spill over the sides of the first transfer system 16*e* as the material stream 12*e* transports downstream toward the discharge end.

A pulley separator 40*e* is located downstream from the discharge end of the first transfer system 16*e*, just beyond a gap 42*e* that is approximately the length of oversized material 26*e* to be removed from the material stream 12*e*. The length of this gap is typically around 12 inches to 24 inches, which is at least as small as the shortest pieces of the oversized material 26*e*. It will be understood that any gap 42*e* long enough to enable only oversized materials 26*e* from the material stream 12*e* over the gap 42*e* will work.

The pulley separator 40*e* comprises a rotatable drum 34*e* that is rotated by a drive mechanism (not shown) and has a tubular width and circular cross-section (not shown). The tubular width of the outer shell 44*e* is typically at least the same width of the first transfer system 16*f*. Having the tubular width of the outer shell 44*e* the same as the width of the first transfer system 16*e* facilitates removal of oversized material 26*e* at any point along the width of the first transfer system 16*e*. It will be understood that any tubular width of the outer shell 44*e*, making removal of the oversized material 26*e* at any point along the width of the first transfer system 16*e* possible, will work.

The outer shell 44*e* of the pulley separator 40*e* generally rotates in the same direction as the movement of the material stream 12*e* being transported by the first transfer system 16*e*. Typically, the outer shell 44*e* of the pulley separator 44*e* rotates at a faster rate of speed than the movement of the material stream 12*e* along the first transfer system 16*e* so as to further facilitate the quick removal of the oversized material 26*e*. Generally the outer shell 44*e* rotates 25% to 50% faster than the movement of the material stream 12*e*. It will be understood that rotating the outer shell 44*e* at any speed facilitating the removal of the oversized material 26*e* will work. It is also possible to incorporate a timing device with the outer shell 44*e* so as to vary the rotational speed of the outer shell 44*e* at different varying speeds or at set time increments, further helping to facilitate the removal of the oversized material 26*e*.

Further downstream, beyond the pulley separator 40*e*, lies a storage device 52*e*, that is typically a shelf, sheet, or collection bin, for collecting oversized material 26*e* that has passed over the pulley separator 40*e* and is ready for collection. It will be understood that any kind of device able to collect oversized material 26*e*, that has passed over the pulley separator 40*e* and is ready for collection, will work. Moreover, there is a short distance between the downstream side of the pulley separator 40*e* and the storage device 52*e*, creating a much smaller second gap 54*e* that only oversized material 26*e* easily slides over. Any material 10*e* from the material stream 12*e* mistakenly goes over the pulley separator 40*e* will drop off on the downstream side of the pulley separator 40*e* into the second gap 54*e*, sending it back into the material stream 12*e*.

Figure 11:
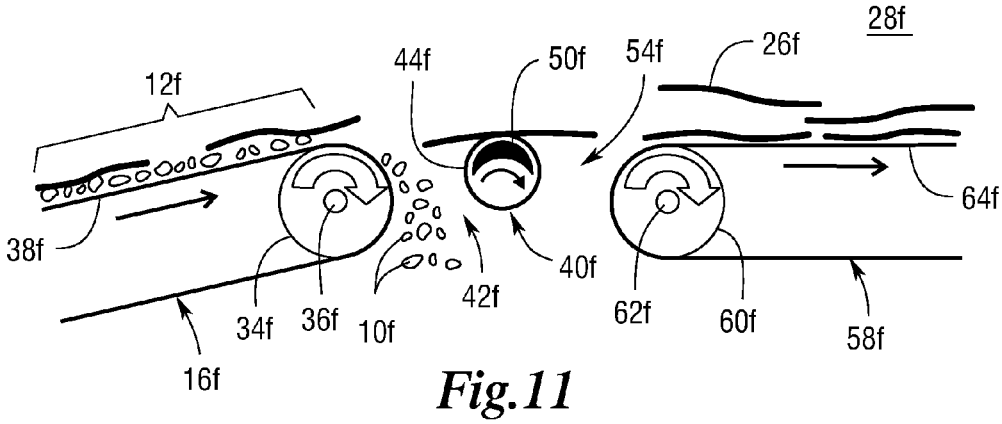
FIG. 11 shows a side view of a fourth embodiment of the oversized removal system.

As shown in FIG. 11, the fourth embodiment of the oversized material removal system 28*f* comprises a second transfer system 58*f*, which is an extraction conveyor, downstream beyond the pulley separator 40*f* is. The second transfer system 58*f* is used for the transportation of the oversized material 26*f* extracted from the material stream 12*f* to another location even further downstream of the oversized material removal system 28*f*. The second transfer system 58*f*, in this embodiment, comprises a rotatable second drum 60*f*, which rotates around a second central axis 62*f*, and a second belt 64*f* that covers the second drum 60*f*.

Figure 12:
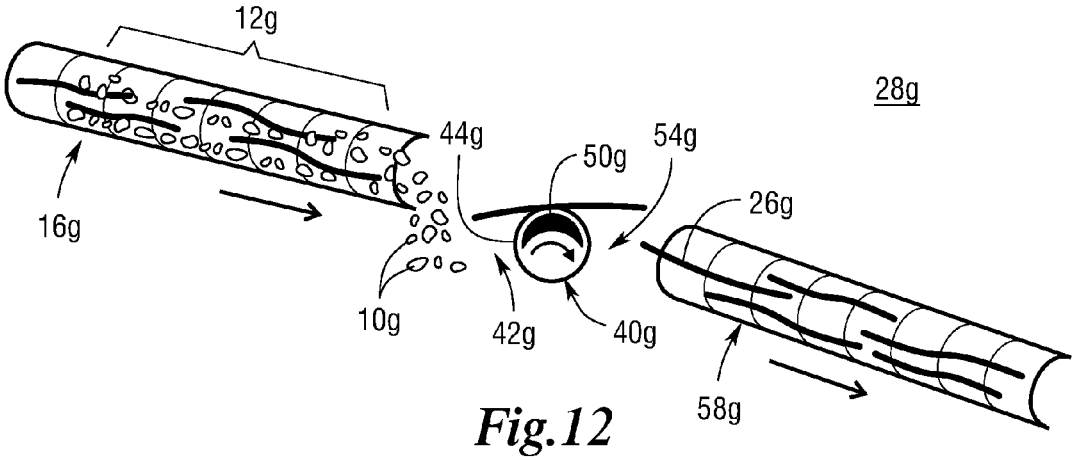
FIG. 12 shows a side view of a fifth embodiment of the oversized removal system.

In a fifth embodiment of the oversized material removal system 28*g*, as shown in FIG. 12, both the first transfer system 16*g* and the second transfer system 58*g* are chutes. The second transfer system 58*g* is used for the transportation of the oversized material 26*g* extracted from the material stream 12*g* to another location further downstream of the oversized material removal system 28*g*.

There is a short distance between the downstream side of the pulley separator 40*g* and the extraction chute 58*g*, creating a much smaller second gap 54*g* that only oversized material 26*g* easily slides over. Any material 10*g* from the material stream mistakenly goes over the pulley separator 40*g* will drop off the downstream side of the pulley separator 40*g* into the second gap 54*g*, sending it back to the material stream 12*g*.

Typically the first transfer system 16*g* and the second transfer system 58*g* are designed to have a channel shape or side walls so that a majority of the oversized material 26*g* remains on the chute and does not spill over the sides of the chute. It will be understood that any appropriate chute design will work for the first transfer system 16*g* and the second transfer system 58*g*.

Figure 13:
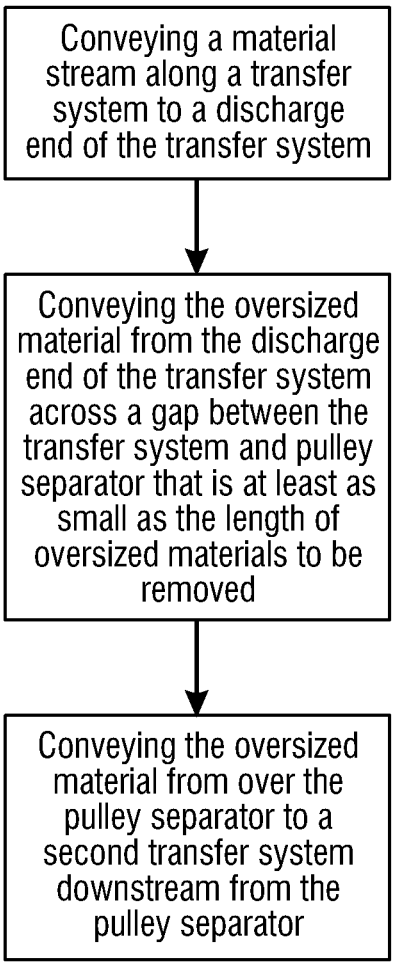
FIG. 13 shows a flow chart of a method of removing oversized from a material stream.

FIG. 13 shows a flow chart of the method of removing oversized materials from a material stream. The material stream to be processed is first conveyed along a transfer system to a discharge end of that transfer system. Next, oversized material from the material stream is conveyed from the discharge end of the transfer system and over a pulley separator located downstream from the transfer system. Oversized material is conveyed across a gap that is situated between the transfer system and pulley separator and is at least as small as the length of oversized material being conveyed across the gap. After being conveyed past the pulley separator, the oversized material is conveyed onto a second transfer system downstream from the pulley separator.

Figure 14:
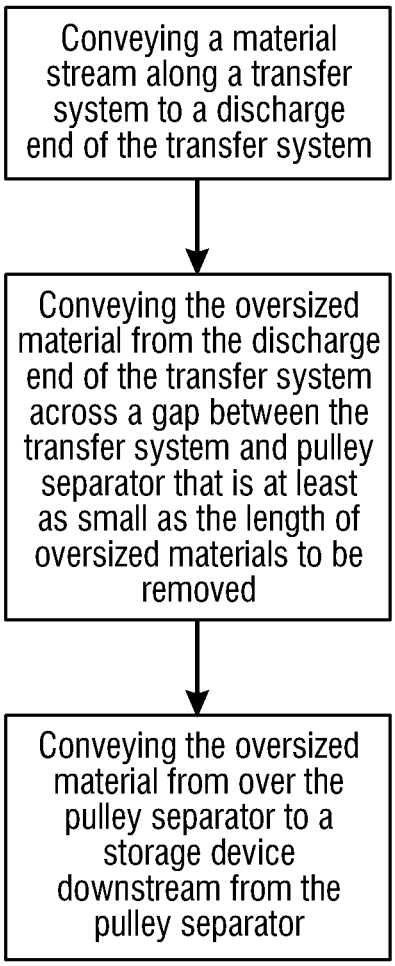
FIG. 14 shows a flow chart of a second embodiment of the method of removing oversized from a material stream.

FIG. 14 shows a flow chart of a second embodiment of the method of removing oversized materials from a material stream. The material stream to be processed is first conveyed along a transfer system to a discharge end of that transfer system. Next, oversized material from the material stream are conveyed from the discharge end of the transfer system and over a pulley separator located downstream from the transfer system. Oversized material is conveyed across a gap that is situated between the transfer system and pulley separator and is at least as small as the length of oversized material being conveyed across the gap. After being conveyed past the pulley separator, the oversized material is conveyed onto a storage device downstream from the pulley separator.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. An oversized material removal system for the removal of oversized materials from a material stream comprising:
- a first transfer system for the transportation of a material stream;
- a pulley separator comprising a rotatable outer shell;
- a magnet located within said outer shell;
- said outer shell having a tubular width and circular cross-section; and
- said pulley separator is located at a discharge end of said first transfer system creating a continuous horizontal gap wherein said first transfer system and said pulley separator are on opposite sides of a vertical axis.

2. The oversized material removal system of claim 1 further comprising a storage device downstream of said pulley separator.

3. The oversized material removal system of claim 1 further comprising a second transfer system downstream of said pulley separator.

4. The oversized material removal system of claim 1 wherein the outermost surface of said outer shell is rubber coated.

5. The oversized material removal system of claim 1 wherein said magnet located within said outer shell is an upwardly oriented magnet.

6. The oversized material removal system of claim 1 wherein said tubular width is at least the width of said first transfer system.

7. The oversized material removal system of claim 1 wherein said first transfer system is a conveyor comprising:
- a drum that is rotatable around a central axis;
- a belt that covers said drum; and
- said drum and said outer shell both rotate in the same general direction.

8. The oversized material removal system of claim 1 wherein said first transfer system is a conveyor comprising:
- a drum that is rotatable around a central axis;
- a belt covering said drum;
- said drum and said outer shell both rotate in the same direction; and
- said outer shell rotates at a faster rate of speed than said drum.

9. The oversized material removal system of claim 1 wherein said continuous horizontal gap is 12 inches to 24 inches.

10. An oversized material removal system for the removal of oversized materials from a material stream comprising:
- a mesh grate for pre-sorting the material stream;
- an aligning device for pre-positioning the oversized materials within the material stream;
- a conveyor for the transportation of the material stream, said conveyor comprising:
  - a drum that is rotatable around a central axis; and
  - a belt covering said drum;
- a pulley separator comprising:
  - a rotatable outer shell;
  - an upwardly oriented permanent magnet located within said outer shell;
  - said outer shell having a tubular width and circular cross-section; and
  - said outer shell is rubber coated;
- said pulley separator is located at a discharge end of said first transfer system to create a continuous horizontal gap wherein said first transfer system and said pulley separator are horizontally separated by a distance spanning at least the size of an opening in said mesh grate;

said drum and said outer shell both rotate in the same general direction;

said outer shell generally rotates at a faster rate of speed than said drum; and a storage device downstream of said pulley separator.

* * * * *